United States Patent [19]

Sveinsbø et al.

[11] 4,357,892

[45] Nov. 9, 1982

[54] APPARATUS FOR WARNING OF THE INCREASE IN DRAUGHT OF A FLOATING ARTICLE, ESPECIALLY A SMALL BOAT, IN A SURROUNDING LIQUID

[76] Inventors: Gunnar Sveinsbo, Gravdalsveien 10, 5034 Ytre Laksevåg; Jan E. Gismervik, Knappenveien 62 A, 5064 Straumsgrend, both of Norway

[21] Appl. No.: 208,763

[22] Filed: Nov. 14, 1980

[51] Int. Cl.[3] ..... B63B 39/12

[52] U.S. Cl. ..... 114/270; 114/121; 114/125; 200/84 C; 335/205; 340/624

[58] Field of Search ..... 114/121, 125, 68, 227, 114/270, 183 R; 340/623, 624; 335/205; 73/307, 308, 315; 200/84 R, 84 C

[56] References Cited

U.S. PATENT DOCUMENTS

| | | | |
|---|---|---|---|
| 973,772 | 10/1910 | Gedeon | 200/84 R |
| 3,482,237 | 12/1969 | Hamburg et al. | 200/84 R |
| 3,633,193 | 1/1972 | Milo | 340/624 |

*Primary Examiner*—Sherman D. Basinger
*Attorney, Agent, or Firm*—Ladas & Parry

[57] ABSTRACT

Apparatus for warning of the increase in draught of a floating article, especially a small boat, in a surrounding liquid. The apparatus includes a signal emitter and a source of current which are connected, via a relay and a switch, to a release unit. The release unit includes a chamber fixedly arranged relative to the article which communicates with the surrounding liquid. The chamber holds a contact device which is adapted to close an electrical circuit when the liquid has risen to a certain level in the chamber.

3 Claims, 2 Drawing Figures

APPARATUS FOR WARNING OF THE INCREASE IN DRAUGHT OF A FLOATING ARTICLE, ESPECIALLY A SMALL BOAT, IN A SURROUNDING LIQUID

BACKGROUND OF THE INVENTION

This invention relates to an apparatus for warning of the increase in draught of a floating article, especially a small boat, in a surrounding liquid.

Problems in connection with the thievery of and from small boats are significant. The locking up of cabins in order to prevent access to the boats is often more detrimental than beneficial in that the thieves thereby inflict significant damage in order to gain access. Many tests have been carried out to solve or reduce the problem, but hitherto no solution has been found which gives a satisfactory result.

SUMMARY OF THE INVENTION

The object of the present invention is to produce an apparatus which generally warns of the increase in draught of an article in a surrounding light, but which has particular application on board small boats for warning of inadmissible boarding or the like.

According to the present invention an apparatus for warning of the increase in draught of a floating article in a surrounding liquid comprises signal emitting means, current source means, release unit means connected to said signal emitting means and said current source means via relay means and switch means, said release unit means comprising a chamber fixedly arranged relatively to said article and communicating with said surrounding liquid, said chamber holding a contact means adapted to close an electrical circuit when said liquid has risen to a certain level in said chamber thereby activating said signal emitting means.

Desirably, the contact means is housed in first float means housed by the chamber, the height position of this float means being adjustable by respectively releasing and clamping a float rod regulatively fixed to the chamber and the float means thus being locked in position when the float rod is clamped so that the apparatus is ready for use. When the rod is released, the first float means floats on the liquid in the chamber.

In a preferred form of the invention, the contact means comprises a switch contact arranged within the float rod at a location where the latter is surrounded by a second float means which moves with the movement of the level of the surrounding liquid and inside and relative to the first float means when locked.

It is also preferred that the chamber incorporates electromagnet means connected via impulse switch means to the current source means, energization of the electromagnet means by closing the impulse switch means causing the float rod to be released enabling the first float means to adjust itself to the level of the liquid while deenergization of the electromagnet means by opening the impulse switch means causes the float rod to be clamped.

Test have shown that heavy seas do not have a negative effect on the reliability of the apparatus, signals thus not being released by heavy seas. A far greater advantage with the apparatus according to the invention is that it does not use current in the rest position, thus when it does not emit.

BRIEF DESCRIPTION OF THE DRAWINGS

In order that the invention can be more clearly understood, a preferred embodiment thereof will now be described, by way of example, with reference to the accompanying drawings in which.

DESCRIPTION OF THE PREFERRED EMBODIMENT

Figure 1:
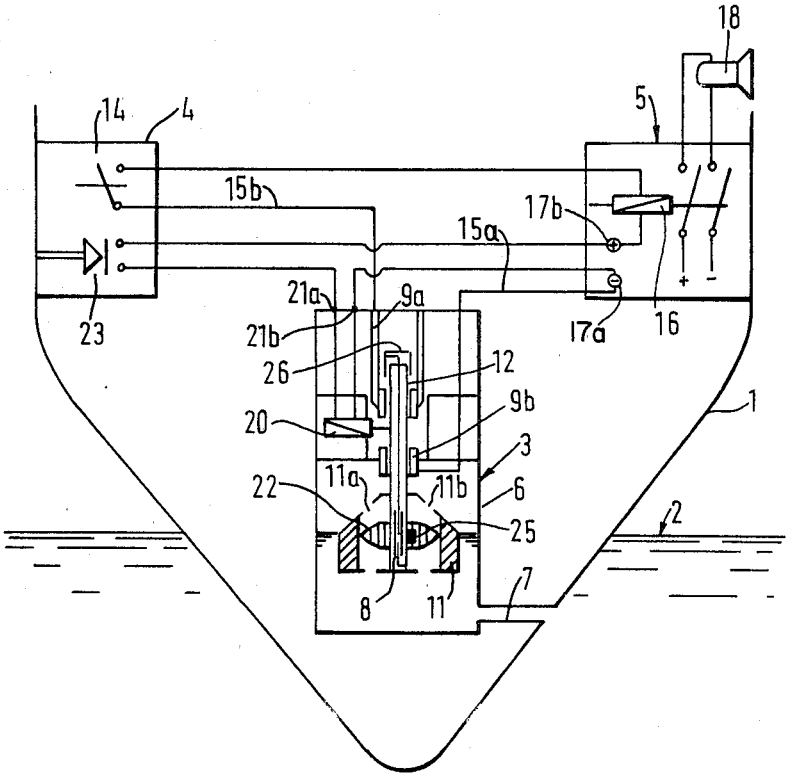
FIG. 1 is a schematic coupling diagram of the apparatus and an indication of its disposition in a boat.
Figure 2:
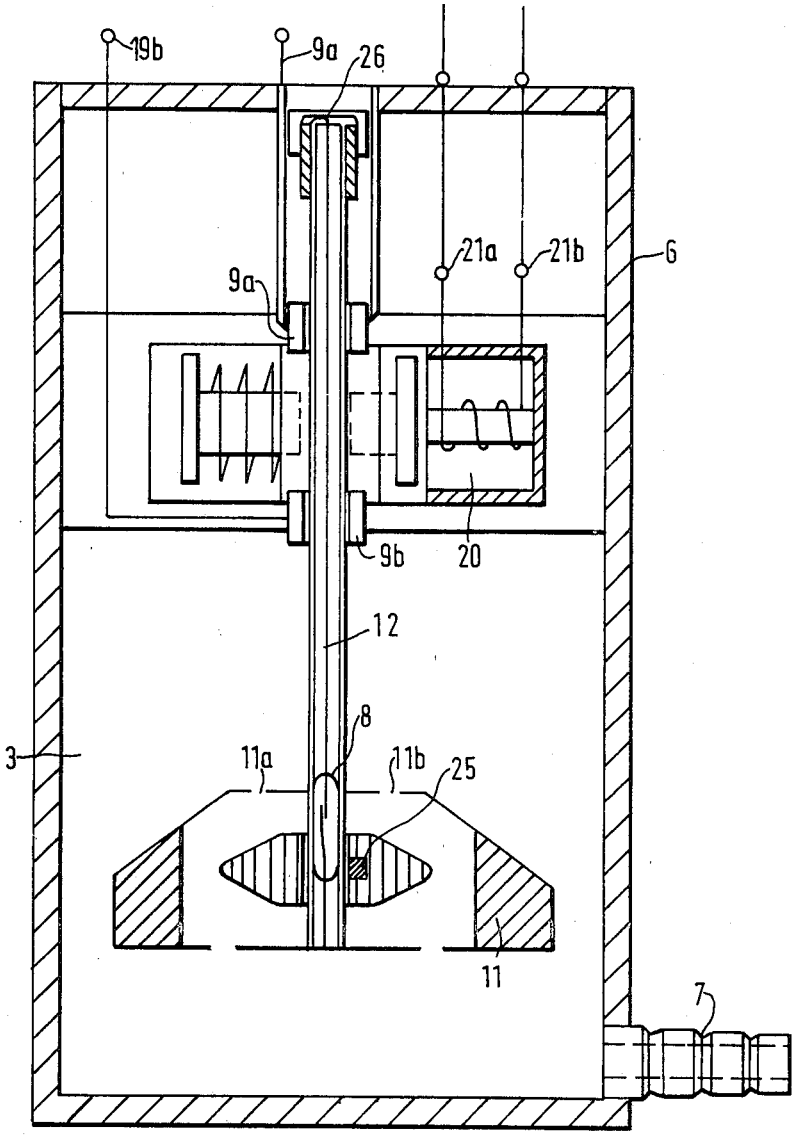
FIG. 2 is a vertical representation on a large scale, partly in section, through a preferred mode of construction of the release unit.

FIG. 1 shows schematically an apparatus according to the invention arranged in a boat 1 which floats in the water to a level 2. The apparatus comprises a release unit 3, a switch panel 4 and a signal emitter unit 5. The release unit 3 comprises a chamber 6, which via a connecting tube 7 communicates with the water outside the boat. Changes in the cross-section of the connecting tube 7 provide a possibility for regulating the inertia of the apparatus. Through the connecting tube there flows water into the chamber 6, where it adjusts itself to the same level as the level 2 outside the boat. Within the chamber 6 there is arranged a float 11 with a hollow float rod 12, which projects down in the water in the chamber, and within the rod there is arranged a switch contact 8 which is coupled respectively via the rod 12 to bushing **9*b* and via a top hood 26 to a bushing 9*a*, which forms a coupling terminal. The float 11 can be locked in a desired position in the chamber, something which will be further explained below. The float 11 is provided above with air holes 11*a*, 11*b*** in order to prevent the build up of pressure.

A second small float 22 with enclosed permanent magnet 25 which floats on the water within the chamber lies around the float rod 12. This magnet 25 actuates in a predetermined position relative to the rod 12 the swith contact 8 which lies within the rod 12.

Via a first switch 14, which is arranged in the switch panel 4, there extends an electrical lead **15*b* from the terminal 9*a* via a relay 16 to the one pole 17*b* of a source of current, usually the boat battery. An electrical lead 15*a* extends from the bushing 9*b* via a second coupling terminal 19*b* to a second pole 17*a* of the source of current. The source of current is also connected to a signal emitter in the form of a whistle 18. The whistle is controlled by the relay 16**.

The apparatus is put into the operative condition by connecting the switch 14. The apparatus thereby finds itself in the rest position, where no current flows. When the boat sinks deeper in the surrounding water, for example due to one person going on board, water will be pressed in through the connecting tube 7 and the water level rises in the chamber 6. The float 11 will in such a situation be locked in a given position and can, therefore, not keep up upwards in the chamber gradually as the water level rises. The second float 22 rises with the water and will at a given position give a magnetic impulse to the switch contact 8 which lies within the rod 12, so that the switch 8 is connected. Then the relay 16 receives current, whereby the whistle begins to emit an alarm. This alarm will last until the water level in the chamber 6 sinks again, so that the electrical circuit is broken via the switch contact 8, and/or the switch 14 is disconnected.

As mentioned above, the float 11 can be locked in a desired position in the chamber 6. This is effected by means of an electromagnet 20 which is arranged in the cover of the chamber 6 and which is coupled to terminals 21*a* and 21*b*. These are for their part connected via an impulse switch 23 to the source of current 17*a*, 17*b*. When the switch 23 is held in, there is effected an energization of the electromagnet 20, something which involves the rod 12 being released and the float 11 adjusts itself to the water level. Thereafter it is locked due to letting go of the switch 23, and the apparatus is ready for use.

Practical tests have shown that heavy seas do not have a negative effect, and will thus not cause undesired release of the warning.

The signal emitter (the alarm) is in the described embodiment a whistle, it can, however, also be a source of light, walkie-talkie or the like.

By sending impulses at uniform intervals to the electromagnet 20, so that the latter releases the float rod 12 in a short period of time, it is possible to produce a self-adjustment of the distance of the switch contact 8 above the water level.

When the conducting ability of the liquid is sufficiently high, such as with sea water, the contact arrangement can comprise two electrodes, where the one constantly projects down in the liquid, while the other is arranged in the float 11. When the level of liquid has risen so far that it comes in contact with the second electrode, an electrical circuit is closed and the alarm is released.

We claim:

1. Apparatus for warning of the increase in draught of a floating article in a surrounding liquid which comprises signal emitting means, current source means, release unit means connected to said signal emitting means and said current source means via relay means and current switch means, said release unit means comprising a chamber fixedly arranged relatively to said article and communicating with said surrounding liquid, said chamber holding a contact means adapted to close an electrical circuit when said liquid has risen to a certain level in said chamber thereby activating said signal emitting means, said contact means being housed in first float means housed by said chamber, the height position of said first float means being adjustable by respectively releasing and clamping a float rod regulatively fixed to said chamber, said first float means thus being locked in position when said float rod is clamped so that said apparatus is ready for use, said chamber incorporating electromagnet means connected via impulse switch means to said current source means, energization of said electromagnet means by closing said impulse switch means causing said float rod to be released enabling said float means to adjust itself to the level of the liquid while deenergization of said electromagnet means by opening said impulse switch means causes said float rod to be clamped.

2. The apparatus of claim 1, wherein said contact means comprises a switch contact arranged within said float rod at a location where the latter is surrounded by second float means which moves with the movement of the level of the surrounding liquid inside and relative to said first float means when locked, said second float means being provided with permanent magnet means capable of activating said switch contact in a predetermined floating position relative to said float rod.

3. The apparatus of claim 1 or 2, wherein the release unit is arranged substantially in the median line of the article with said contact means disposed adjacent the level of the surrounding liquid.

* * * * *